US007749342B2

(12) United States Patent
Peslerbe et al.

(10) Patent No.: US 7,749,342 B2
(45) Date of Patent: Jul. 6, 2010

(54) REINFORCED COMPOSITE MECHANICAL COMPONENT, AND METHOD FOR MAKING SAME

(75) Inventors: Isabelle Peslerbe, Ollainville (FR); Jacques Tschofen, Bologne (FR); Anne Thenaisie, Evry (FR)

(73) Assignees: SNECMA, Paris (FR); Forges de Bologne, Bologne (FR)

( * ) Notice: Subject to any disclaimer, the term of this patent is extended or adjusted under 35 U.S.C. 154(b) by 1011 days.

(21) Appl. No.: 10/522,182

(22) PCT Filed: Jul. 25, 2003

(86) PCT No.: PCT/FR03/02350

§ 371 (c)(1),
(2), (4) Date: Feb. 1, 2006

(87) PCT Pub. No.: WO2004/011687

PCT Pub. Date: Feb. 5, 2004

(65) Prior Publication Data

US 2006/0127693 A1 Jun. 15, 2006

(30) Foreign Application Priority Data

Jul. 25, 2002 (FR) ..... 02 09444

(51) Int. Cl.

| | |
|---|---|
| ***B64C 11/20*** | (2006.01) |
| ***B23P 11/00*** | (2006.01) |
| ***B23P 19/00*** | (2006.01) |
| ***B23P 17/00*** | (2006.01) |

(52) U.S. Cl. ..... 148/535; 148/527; 29/505; 29/508; 416/224; 416/229 R

(58) Field of Classification Search ..... None
See application file for complete search history.

(56) References Cited

U.S. PATENT DOCUMENTS 4,314,007 A 2/1982 Gessinger (Continued)

FOREIGN PATENT DOCUMENTS

| | | |
|---|---|---|
| DE | 41 37 839 | 5/1993 |
| EP | 0 019 569 | 11/1980 |
| EP | 0 809 050 | 11/1997 |
| GB | 2 242 848 | * 4/1990 |

OTHER PUBLICATIONS

Qin X et al: "Research on Distribution Od Sic Particles in Aluminum-Alloy Matrix Functionally Graded Composite Tube Manufactured by Centrifugal Casting" Journal of Materials Science Letters, Chapman and Hall Ltd. vol. 21, No. 8, pp. 665-667, Apr. 15, 2002.

(Continued)

*Primary Examiner*—Jennifer McNeil
*Assistant Examiner*—Jason L Savage
(74) *Attorney, Agent, or Firm*—Oblon, Spivak, McClelland, Maier & Neustadt, L.L.P.

(57) ABSTRACT

A mechanical part presents a main direction along which there extends a central zone forming a core and a peripheral zone forming a casing that surrounds the core. The core and the casing present a metallurgical bond between each other. The core is made of a first material presenting at least a metal matrix, and the casing is made of a second material presenting at least a metal matrix. The metal matrices of the first and second materials are based on the same metal, and at least one of the first and second materials is made of a metal matrix composite containing reinforcing elements dispersed in the metal matrix. The mechanical part can be used as a blade for a fan or a low pressure compressor.

8 Claims, 2 Drawing Sheets

U.S. PATENT DOCUMENTS

| | | | | |
|---|---|---|---|---|
| 4,850,802 | A * | 7/1989 | Pankratz et al. | 416/213 R |
| 5,490,764 | A * | 2/1996 | Schilling | 416/239 |
| 5,511,604 | A * | 4/1996 | Ravenhall et al. | 164/97 |
| 6,190,133 | B1 * | 2/2001 | Ress et al. | 416/229 A |
| 6,379,480 | B1 * | 4/2002 | Girault et al. | 148/521 |
| 6,773,817 | B1 * | 8/2004 | Sagel et al. | 428/457 |
| 2001/0029668 | A1 * | 10/2001 | Schreiber | 29/889.7 |
| 2006/0275626 | A1 * | 12/2006 | Bernard et al. | 428/698 |

OTHER PUBLICATIONS

Qin X et al: "Research on Distribution OD SIC Particles in Aluminum-Alloy Matrix Functionally Graded Composite Tube Manufactured by Centrifugal Casting" Journal of Materials Science Letters, Chapman and Hall Ltd. vol. 21, No. 8, pp. 665-667, Apr. 15, 2002.

* cited by examiner

REINFORCED COMPOSITE MECHANICAL COMPONENT, AND METHOD FOR MAKING SAME

The present invention relates to obtaining a mechanical part presenting a main direction along which there extend a central zone forming a core and a peripheral zone forming a casing which surrounds said core, said core and said casing presenting a metallurgical bond between each other, said core being made of a first material presenting at least a metal matrix, and said casing being made of a second material presenting at least a metal matrix.

More precisely, the invention relates to:

- a mechanical part made out of two portions comprising a core made of a first material presenting at least a metal matrix and a casing or jacket made of a second material presenting at least a metal matrix; and
- a method of manufacture that enables said above-specified mechanical part to be obtained by implementing the method.

In particular, and in non-limiting manner, the present invention relates to obtaining a mechanical part in which the metal matrix of the first material and/or of the second material presents aluminum as its base metal.

In a preferred, but non-limiting application, the present invention relates to a mechanical part used in the field of aviation, in particular at a moving blade or stationary vane of a compressor, in particular a low pressure compressor, or as a fan blade of a turbojet.

Nevertheless, the present invention is not limited to making blades or vanes, nor is it applicable solely to the field of aviation: other types of mechanical part can be envisaged, in particular in the fields of machine tools or in the automobile industry, such as casings, tubes, cylinders, or wear parts for use in braking.

Specifically, mechanical parts of ever-decreasing weight and presenting good characteristics of mechanical strength and ability to withstand high temperatures are required in applications of various types.

Thus, in particular in the field of aviation, and more precisely in turbojets, materials are required having characteristics of mechanical strength and ability to withstand temperature that are good, in particular for manufacturing stationary vanes and/or moving blades.

At present, titanium alloys are in widespread use for this purpose, thereby suffering in particular from the drawbacks of high raw material costs and also of weight that is sometimes considered to be excessive.

Solutions seeking to make hollow parts out of titanium serving to lighten such structures are also in use, thus requiring manufacturing techniques that are relatively sophisticated and expensive.

Reference can be made to U.S. Pat. No. 6,218,026 which proposes making a hybrid mechanical part made up in particular of two different titanium alloys disposed respectively at the locations of the inner portions and the outer portions of the part. According to that prior art document, the inner portion and the outer portion are connected together by a metallurgical bond obtained by hot isostatic pressing.

In any event, the aim is to obtain a mechanical part having a modulus of elasticity that is greater in its inner portion than in its outer portion so as to improve the mechanical properties of the part without greatly altering its density.

Nevertheless, the use of a titanium alloy is also undesirable from the point of view of the weight of the mechanical part and from the point of view of raw material cost, given that the hot isostatic pressing technique is expensive to implement.

An object of the present invention is to mitigate the drawbacks of those prior art techniques by proposing a mechanical part and a method of manufacturing it using metallurgical techniques that are simple to implement.

In one of its aspects, the present invention thus provides a mechanical part presenting a main direction along which there extend a central zone forming a core and a peripheral zone forming a casing which surrounds said core, said core and said casing presenting a metallurgical bond between each other, said core being made of a first material presenting at least a metal matrix, and said casing being made of a second material presenting at least a metal matrix.

In characteristic manner, said metal matrices of the first and second materials are based on the same metal, and at least one of said first and second materials is made of a metal matrix composite containing reinforcing elements dispersed in said metal matrix.

In this way, it will be understood that it is possible to obtain a part presenting a core and a covering presenting between them an interface constituted by a physico-chemical bond of very good quality because of the similarity between the first and second materials which are both based on the same base metal.

The characteristics of the interface between the two materials forming a single part, which can thus be referred to as a "complex" part, are thus of great importance, particularly when at least one of the materials is a metal-matrix composite: using identical metal as the basis of the composition for the first and second materials is, in this respect, of great importance in obtaining a core and a casing that form between them a metallurgical bond presenting high mechanical strength.

In addition, because of the presence of reinforcing elements in at least one of the first and second materials, this arrangement makes it possible, in the portion where the part needs to be reinforced, to improve its mechanical strength characteristics and possibly also its ability to withstand high temperatures, while nevertheless retaining density overall that is similar to that of the metal matrix.

Incidentally, it should be observed that, depending on the application intended for the mechanical part, either one of the first and second materials (core and casing) or both of the first and second materials (core and casing) is/are constituted by a metal matrix composite having reinforcing elements dispersed in said metal matrix.

In the first case, the composition of the first material is different from that of the second material, at least concerning the quantity of reinforcing elements present.

The following dispositions are preferably adopted, either independently or in combination:

- said base metal is aluminum;
- said metal matrices of the first and second materials are respectively constituted by a first alloy and a second alloy, said first alloy and said second alloy being selected from aluminum-based alloys of the ASTM standards series 2000, 5000, 6000, or 7000; preferably, said first alloy and said second alloy are selected from the same series of aluminum-based alloys selected from said ASTM standard series 2000, 5000, 6000, or 7000, and in particular from the 2000 series;
- said reinforcing elements are particles of silicon carbide (SiC), of alumina ($Al_2O_3$), or of metal carbide such as tungsten, boron, or titanium carbide;
- said reinforcing elements represent no more than 50% by weight of the composition of said metal matrix composite; preferably, said reinforcing elements represent 5% to 35% and preferably 10% to 20%, and more preferably about 15% by weight of the composition of said metal matrix composite;

one of said first and second materials is made of said metal matrix composite containing said reinforcing elements dispersed in said metal matrix, the other one of said first and second materials being made of said metal matrix only;

said first material is made of said metal matrix only, which comprises aluminum as its base metal, and said second material is made of said metal matrix composite containing said reinforcing elements dispersed in said metal matrix, said metal matrix having aluminum as its base metal and said reinforcing elements being made of silicon carbide (SiC) particles: this preferred selection serving to benefit from the good ability of Al/SiC to withstand erosion and impact, and also its greater rigidity;

said first and second materials are made of said metal matrix composite containing said reinforcing elements dispersed in said metal matrix, said reinforcing elements representing different percentages by weight of the composition of said metal matrix composite in said core and in said casing;

said reinforcing elements represent a percentage by weight of the composition of said metal matrix composite that varies progressively in said first material and in said second material going from the center of said core towards the periphery of said casing;

for said reinforcing elements, said first material presents a percentage by weight of the composition of said metal matrix composite that is greater than in said second material; and for said reinforcing elements, said second material presents a percentage by weight of the composition of said metal matrix composite that is greater than in said first material.

In a preferred, but non-limiting, application of the metal part of the invention, said metal part constitutes a blade.

Such a blade may belong to a compressor, in particular a low pressure compressor, and may constitute either a stationary vane or a moving blade.

Similarly, such a blade may be used for making a turbojet fan.

In another aspect, the present invention provides a method of manufacture which, when implemented, serves to obtain the above-specified mechanical part.

In general, the method of manufacture of the present invention serves to obtain a mechanical part by implementing the following steps:

a) compacting to make a semi-finished product containing a core and a casing, said core and said casing presenting a metallurgical bond between each other, said core being made of a first material presenting at least a metal matrix, and said casing being made of a second material presenting at least a metal matrix, said metal matrices of the first and second materials being based on the same metal, and at least one of said first and second materials being made of a metal matrix composite containing reinforcing elements dispersed in said metal matrix;

b) forging the semi-finished product to obtain a blank; and c) machining said blank to provide a finished product forming said mechanical part.

Step a) may be implemented in various ways without going beyond the ambit of the present invention.

In a first solution, said step a) consists in forming the core and the casing conjointly by the powder metallurgy technique. In this technique, which compresses a powder in a matrix and then applies "sintering" heat treatment, it is possible to obtain a metal part that directly constitutes a semi-finished product.

This first solution is particularly well suited to the situation in which it is desired to obtain a mechanical part in which said reinforcing elements represent a percentage by weight of the composition of said metal matrix composite that varies in said first material (core) and in said second material (casing) going from the center of said core towards the periphery of said casing, either by decreasing on going away from the center or by increasing on going away from the center, e.g. between a minimum of 0% to 10%, and a maximum no greater than 50% by weight.

Nevertheless, this first solution is not restricted to the above circumstances and it may also be applied to the two circumstances mentioned below:

said first and second materials are made of said metal matrix composite containing said reinforcing elements dispersed in said metal matrix, said reinforcing elements representing different percentages by weight of the composition of said metal matrix composite in said core and in said casing; and one of said first and second materials is made of said metal matrix composite containing said reinforcing elements dispersed in said metal matrix, while the other one of said first and second materials is made of said metal matrix alone.

In a second solution, said step a) consists in performing the following substeps in succession:

a1) using said first material to make a rod extending in a longitudinal direction, said rod serving to form said core placed in the center of the mechanical part;

a2) using said second material to make a sleeve extending in a longitudinal direction, said sleeve serving to form the casing of the mechanical part by surrounding said core;

a3) inserting the rod into the sleeve to form an assembly; and a4) passing said assembly through an orifice of small section in order to reduce at least one dimension of said assembly in a direction perpendicular to said longitudinal direction in order to create a metallurgical bond between said rod and said sleeve.

This second solution is well adapted in particular to the situation in which it is desired to obtain a mechanical part where said reinforcing elements are present only in one of said first and second materials, the other one of said first and second materials being made solely of said metal matrix. The powder metallurgy technique is then used more particularly for making that one of the core (first material) and the casing (second material) which contains reinforcing elements.

Substep a4) in the second solution for step a) preferably consists in rolling or extruding the assembly, i.e. forcing it while hot to pass between successive pairs of cylinders that are ever closer together or through dies of ever smaller section.

In general, this step a) uses a technique that implements compacting, in particular by applying pressure between the core and the casing, either at the time they are formed simultaneously (first solution), or at the time of their initial formation as separate pieces (second solution), so as to create a bond between the materials constituting them that is of the metallurgical type, giving rise to a good interface.

Naturally, this metallurgical type bond forms contact that is more intimate than a mechanical bond, the first and second materials being so close together that inter-atomic forces come into play. Such an interface enables the mechanical part to withstand the various stresses to which it is subjected in satisfactory manner.

When implementing forging step b), several solutions are possible without going beyond the ambit of the present invention.

In general terms, forging consists in a metallurgical operation seeking to transform ingots into blanks of determined shape by deforming a metal that has been raised to a temperature where it becomes sufficiently malleable, the deformation being obtained either by impact (hammering, stamping) or by applying pressure (closed-matrix presses) between two tools.

In a preferred solution, the forging step consists in die stamping. Other forging techniques may also be used singly or in combination with die stamping: forging in a press, hammering, . . . .

In particular, the method of manufacture of the present invention applies to a first material which is made solely out of said metal matrix based on aluminum, and a second material which is made of said metal matrix composite containing said reinforcing elements dispersed in said metal matrix, the metal matrix being based on aluminum and said reinforcing elements being formed by particles of silicon carbide (SiC): this preferred selection makes it possible to benefit from the very good interaction between an aluminum alloy and particles of SiC, as explained in U.S. Pat. No. 6,135,195, thereby obtaining a material that is lower in cost than titanium.

In addition, selecting aluminum as the base metal makes it possible to benefit from its good elongation properties, in particular during the forging step, and also when applying the second solution for step a) during rolling or extrusion step a4) of passing through an orifice of smaller section, and also makes it possible to benefit from its good corrosion behavior.

The invention will be better understood and its secondary characteristics and their advantages will appear more clearly on reading the following description of embodiments of the mechanical part of the invention as given below by way of example.

The description and the drawings are naturally given purely by way of non-limiting indication.

Reference is made to the accompanying drawings, in which.

Figure 1:
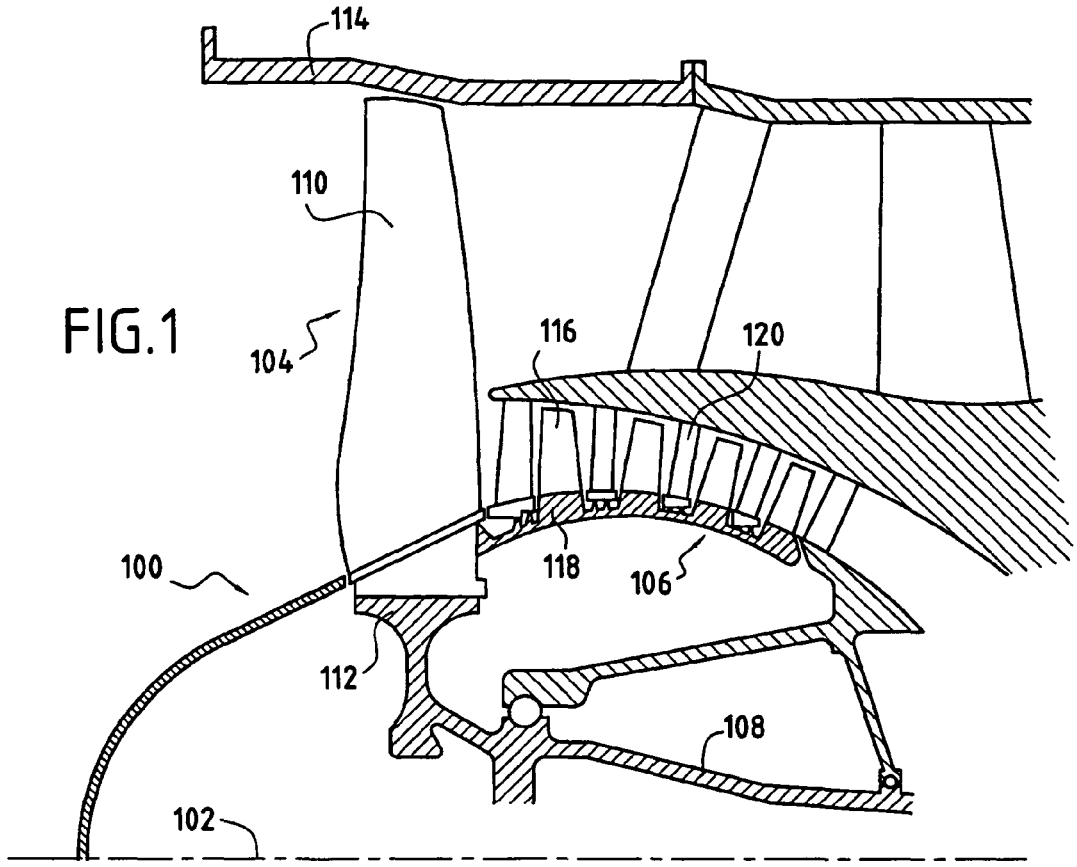
FIG. 1 is a fragmentary longitudinal section view of a bypass turbojet showing a fan and an accelerator illustrating possible applications for the mechanical part of the present invention by way of example.

An example of possible applications of the mechanical part of the present invention is shown in FIG. 1 in the form of a bypass turbojet 100.

The turbojet 100 comprises a conventional structure having various elements disposed axially around a longitudinal axis 102 and with fluid communication between one another, and in particular it shows a fan 104 and an accelerator or booster 106.

Naturally, such a turbojet has other elements that are conventional for such a structure, in particular a high pressure compressor, a combustion chamber, a high pressure turbine, and a low pressure turbine, these various additional elements not being shown for reasons of clarity.

The fan 104 and the accelerator 106 are driven in rotation by the low pressure turbine by means of a rotor shaft 108.

The fan 104 comprises a series of blades 110 extending radially and mounted on an annular disk 112: only one of these blades is shown in FIG. 1. Naturally the disk 112 and the blades 110 are mounted to rotate about the axis 102 of the engine 100.

The engine 100 also includes a fan casing 114.

The accelerator 106 comprises a plurality of series of moving blades 116 that are mounted to rotate on a disk 118, and that have series of stationary vanes 120 mounted between them.

The present invention relates to obtaining a mechanical part suitable, in particular, for constituting each of the blades 110 of the fan 104 and/or each of the moving blades 116 and/or each of the stationary vanes 120 of the accelerator 106.

Likewise, the mechanical part of the present invention may also constitute the stationary and/or moving vanes and/or blades of other elements in such a turbojet, identical or different from that shown in FIG. 1, such as a compressor, and in particular a low pressure compressor.

As mentioned above, the mechanical part of the present invention can also be used in fields other than that of aviation in order to make structural elements that need to be mechanically strong while presenting a structure that is relatively lightweight.

An implementation of the manufacturing method of the present invention suitable for obtaining the above-mentioned blades is described below.

In this non-limiting implementation, consideration is given to making a blade comprising a core made of a first material based on an alloy of aluminum, and a casing made of a second material constituted by a metal matrix composite in which the metal matrix is an aluminum-based alloy and the reinforcing elements are particles of silicon carbide (SiC).

Under such circumstances, an aluminum rod 10 is initially made using conventional aluminum alloy fabrication techniques.

A sleeve 20 is also made out of the second above-mentioned material forming a metal matrix composite which can be obtained by a powder metallurgy technique.

The next step consists in introducing the rod 10 into the sleeve 20 so as to form an assembly 30: at this stage it is clear that there exists clearance or even empty space between the outside surface of the rod 10 and the inside surface of the wall of the sleeve 20.

Figure 2:
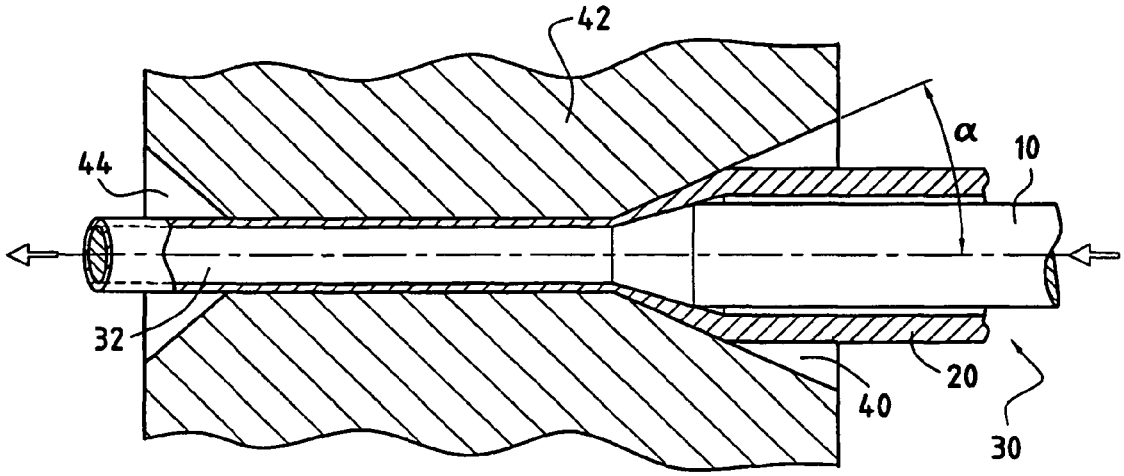
FIG. 2 is a longitudinal section view of the arrangement enabling one of the steps of the manufacturing method of the present invention to be performed, in one of the solutions possible.

In order to secure the rod 10 and the sleeve 20 of the assembly 30 together, while simultaneously achieving a good interface between these two elements, an extrusion operation is performed as shown in FIG. 2.

In FIG. 2, the assembly 30 appears as being inserted into the inlet 40 of a die 42. This inlet 40 is in the form of a truncated cone having a half-angle $\alpha$ at the apex forming the reduction angle. This inlet 40 presents an upstream diameter greater than the outside diameter of the sleeve 20, while the downstream diameter of the inlet 40 presents a diameter that is smaller than the diameter of the rod 10.

Consequently, while being forced hot through the inlet 40 of the die 42, the assembly 30 is reduced in section by being lengthened, with an interface being created between the rod 10 and the sleeve 20 which thus together form a complex semi-finished product 32 at the outlet 44 of the die 42.

Naturally, the extrusion step shown in FIG. 2, may comprise a plurality of successive passes through dies presenting ever smaller diameters.

In the implementation shown, the reduction angle $\alpha$ is equal to 30°, and this reduction angle may, in general, lie in the range 1° to 45°, and preferably in the range 5° to 35°.

In this way, a reduction in section is obtained between the assembly 30 and the complex semi-finished product 32 that is of the order of 10% to 70%, and preferably lies in the range 20% to 60%.

It can be observed that this extrusion technique, in particular when it is performed by successive passes through a series of dies, enables good cohesion to be obtained between the materials constituting the core and the casing because of the pressure exerted between the surfaces in friction contact.

This example of implementation has been performed using a rod 10 presenting a diameter of 30 millimeters (mm) and made of an aluminum alloy of the 2024 T4 series, while the sleeve 20 had an outside diameter of 70 mm and an inside diameter of 40 mm and was made of a second material forming a metal matrix composite, the metal matrix being an aluminum alloy of the 2024 T4 series and the reinforcing element being made of silicon carbide particles having a mean size of 5 micrometers (μm) and constituting 15% by weight.

Such extrusion can be performed at ambient temperature or it can be performed hot, and in particular it can be performed at a temperature of about 400° C.

After extrusion, the subsequent step in the implementation described in detail herein consists in forging by die stamping in order to impart the quasi-final shape to the blade.

Such die stamping is performed in successive steps in dies tending progressively towards the final shape of the blade under conditions of pressure and temperature that are adapted to the materials so as to maintain a good interface and good adhesion between the core and the casing: a temperature of about 430° C. and a pressure of about 100 megapascals (MPa) has been used in particular.

Figure 3:
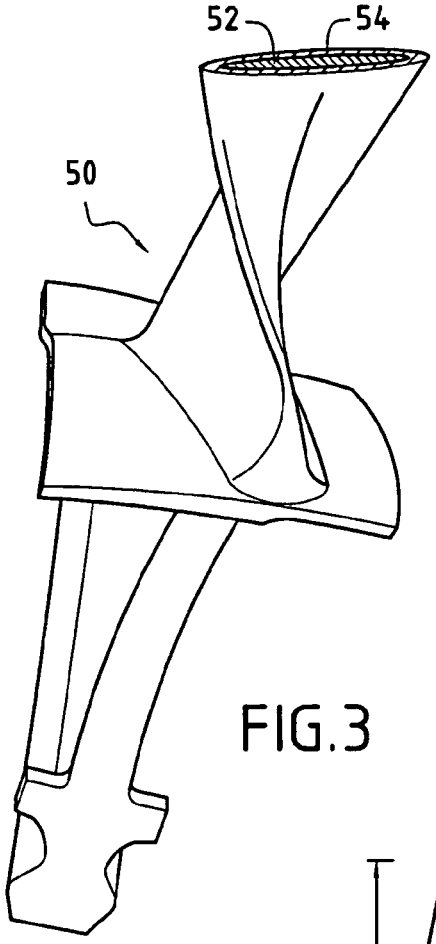
FIGS. 3 and 4 are perspective views of blades shown truncated at their radially outer ends and illustrating possible applications of the mechanical part of the present invention.
Figure 4:
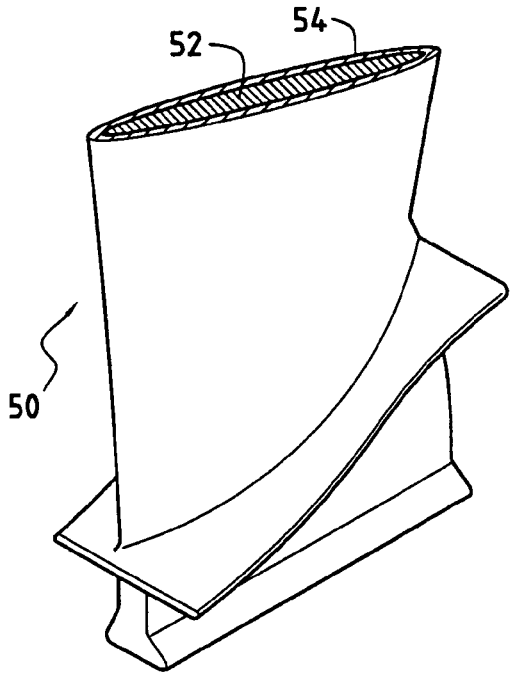
Figure 5:
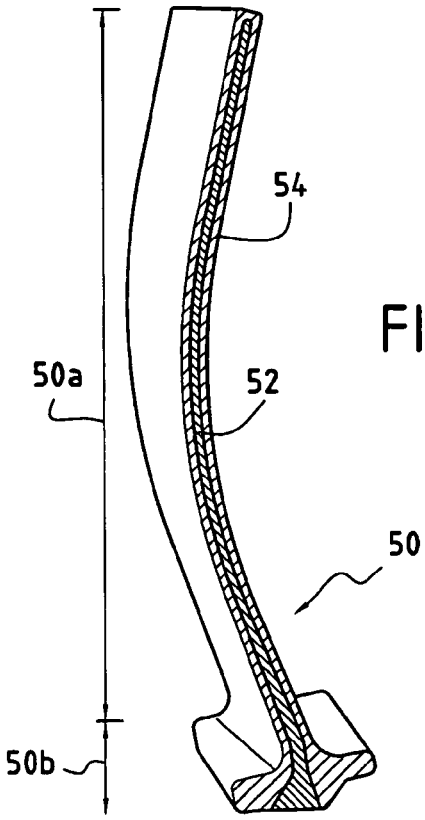
FIG. 5 is a fragmentary perspective view in section in the longitudinal direction of another blade that can be constituted as a mechanical part of the present invention.

At the end of these forging steps by die stamping the semi-finished product 32, a blank is obtained (not shown) which is then machined in order to obtain the finished product forming the mechanical part of the invention, and in particular a blade such as the blades shown in FIGS. 3 to 5.

In these figures, the blade 50, which is shown as having various shapes, comprises a core 52 made of the first material initially constituting the rod 10, while the casing 54 surrounding the core 52 is made of the second material initially forming the sleeve 20 of the assembly 30 shown in FIG. 2.

As can be seen in the cross-section portions of FIGS. 3 and 4 and also in the longitudinal section zone of FIG. 5, the blade 50 presents a regular distribution of the first and second materials between the core 52 and the casing 54.

This highly satisfactory result is obtained, quite unexpectedly, by techniques that are relatively simple to implement, thereby achieving mechanical properties that are uniform, in particular in the various portions of the web 50*a* of the blade, and also continuity between the mechanical properties of the blade between its web 50*a* and its root 50*b* (see FIG. 5).

In this implementation, it will be understood that the aluminum alloy is placed in the central portion of the blade, thus making it possible to benefit from the bending properties of aluminum, whereas the Al/SiC non-metal matrix composite is at its surface, thus providing greater stiffness and improved ability to withstand impacts and erosion.

It should naturally be understood that depending on the intended application of the mechanical part obtained by the present invention, in particular which portion of the part requires greater stiffness, it is possible to choose to place the Al/SiC metal matrix composite in the core of the mechanical part or else in its casing (at the surface of the mechanical part).

The present invention is not limited to using reinforcing elements in the form of silicon carbide particles, it is also possible to use particles of alumina ($Al_2O_3$) or of metal carbides such as tungsten carbide, boron carbide, or titanium carbide.

Also, as set out in the introduction, the present invention applies likewise to making a mechanical part made entirely out of metal matrix composite material, which material may present a composition in reinforcing elements that varies progressively from the center of the core towards the periphery of the casing.

The invention claimed is:

1. A method of manufacturing a blade, comprising:

a) compressing a core and a casing to make a semi-finished product containing said core and said casing, said core and said casing including a metallurgical bond between each other resulting from said compression, said core including a first material that includes at least an aluminum based metal matrix, and said casing including a second material that includes at least an aluminum based metal matrix, and at least one of said first and second materials being made of a metal matrix composite containing reinforcing elements dispersed in said metal matrix;

b) forging the semi-finished product to obtain a blank with a quasi-final shape of the blade; and c) machining said blank to provide a finished product forming said blade.

2. A method of manufacture according to claim 1 for obtaining a blade in which said first and second materials include said metal matrix composite containing said reinforcing elements dispersed in said metal matrix, wherein said reinforcing elements represent a percentage by weight of the composition of said metal matrix composite that varies progressively in said first material and in said second material in a direction from a center of said core towards a periphery of said casing, and wherein said compressing said core and said casing includes forming the core and the casing conjointly by a powder metallurgy technique.

3. A method of manufacture according to claim 1, wherein said compressing said core and said casing includes performing, in succession:

a1) using said first material to make a rod extending in a longitudinal direction, said rod serving to form said core placed in a center of the mechanical part;

a2) using said second material to make a sleeve extending in a longitudinal direction, said sleeve serving to form the casing of the mechanical part by surrounding said core;

a3) inserting the rod into the sleeve to form an assembly; and a4) passing said assembly through an orifice of small section to reduce at least one dimension of said assembly in a direction perpendicular to said longitudinal direction to create a metallurgical bond between said rod and said sleeve.

4. A method of manufacture according to claim 3, wherein said passing said assembly through the orifice includes rolling or extrusion.

5. A method of manufacture according to claim 3, wherein said passing said assembly through the orifice is performed at an elevated temperature.

6. A method of manufacture according to claim 5, wherein said passing said assembly through the orifice is performed at a temperature of about 400° C.

7. A method of manufacture according to claim 1, wherein said forging includes die stamping.

8. A method of manufacture according to claim 7, wherein said die stamping is performed at a temperature of about 430° C. and a pressure of about 100 MPa.

* * * * *